US006640387B2

(12) United States Patent
Alonso

(10) Patent No.: US 6,640,387 B2
(45) **Date of Patent: *Nov. 4, 2003**

(54) DAMPER ASSEMBLY THAT OPTS TO OPEN DOORS FOR USAGE WITH RECIPROCATING DOOR CLOSER DEVICES

(76) Inventor: Ricardo Alonso, 111 S. Perry St., Denver, CO (US) 80219

( * ) Notice: Subject to any disclaimer, the term of this patent is extended or adjusted under 35 U.S.C. 154(b) by 44 days.

This patent is subject to a terminal disclaimer.

(21) Appl. No.: 09/731,947

(22) Filed: Dec. 6, 2000

(65) Prior Publication Data

US 2001/0007163 A1 Jul. 12, 2001

Related U.S. Application Data

(63) Continuation-in-part of application No. 09/473,822, filed on Dec. 28, 2000, now Pat. No. 6,397,431.

(51) Int. Cl.[7] ..... E05F 1/08
(52) U.S. Cl. ..... 16/72; 16/71; 16/66
(58) Field of Search ..... 16/66, 67, 71, 16/72; 188/129; 267/34, 136

(56) References Cited

U.S. PATENT DOCUMENTS

| | | | | | |
|---|---|---|---|---|---|
| 1,662,395 | A | * | 3/1928 | Norton | 16/66 |
| 1,675,980 | A | * | 7/1928 | Lebherz | 16/66 |
| 2,042,954 | A | * | 6/1936 | Memmel | 16/72 |
| 2,732,920 | A | | 1/1956 | Newton | |
| 2,920,338 | A | | 1/1960 | Falk | |
| 3,032,806 | A | | 5/1962 | Mallory | |
| 3,162,889 | A | | 12/1964 | Runnels | |
| 3,249,961 | A | * | 5/1966 | Quinn | 16/66 |
| 3,566,435 | A | | 3/1971 | Nakamura | |
| 3,665,549 | A | | 5/1972 | Quinn | |
| 3,781,943 | A | | 1/1974 | Cain | |
| 3,852,846 | A | | 12/1974 | Slaybaugh | |
| 3,887,961 | A | | 6/1975 | Sagjos | |
| 3,891,111 | A | | 6/1975 | Snazuk | |
| 4,048,694 | A | | 9/1977 | Newman | |
| 4,115,897 | A | | 9/1978 | Zunkel | |
| 4,194,264 | A | * | 3/1980 | Stoffregen | 16/52 |
| 4,339,843 | A | | 7/1982 | Burnett | |
| 4,357,731 | A | * | 11/1982 | Strauss | 16/70 |
| 4,382,311 | A | | 5/1983 | Watts | |
| 4,486,917 | A | * | 12/1984 | Johnston et al. | 16/337 |
| 4,489,640 | A | | 12/1984 | Olson | |
| 4,506,407 | A | | 3/1985 | Downey | |
| 4,639,969 | A | | 2/1987 | Obenshain | |
| 4,648,151 | A | * | 3/1987 | Whaley | 16/49 |
| 4,660,250 | A | | 4/1987 | Tillman | |
| 4,688,695 | A | | 8/1987 | Hirohata | |
| 4,709,445 | A | | 12/1987 | Waldo | |
| 4,777,698 | A | | 10/1988 | Lord | |
| 4,813,100 | A | | 3/1989 | King | |
| 4,815,163 | A | | 3/1989 | Simmons | |
| 4,828,236 | A | | 5/1989 | Inoue | |
| 4,878,265 | A | | 11/1989 | Nesbitt | |
| 4,894,883 | A | | 1/1990 | Fleischhauer | |
| 4,920,609 | A | | 5/1990 | Lin | |

(List continued on next page.)

*Primary Examiner*—Anthony Knight
*Assistant Examiner*—Vishal Patel

(57) ABSTRACT

An assembly (50) adapted to a reciprocative door closer device (10) and contingent door (62), the device (10) comprising a rod (16) and a body (12) having a biasing means (11) normally operating to comprise decreasing actuation and causing the rod (16) and door (62) towards a closed position (62-A); the assembly (50) including as extensible bracket (50-A) joined to a fixated bracket (50-B) and a spring means (54) capable of providing a counter biasing means (55) normally operating as substantially inactive, unless, said assembly (50) detects an excessive inward force (11-B) as exceeding said device (10), wherein said assembly (50) responsively opts to regulate the a increasing outward actuation (55-B) towards the closed position (62-A) and a decreasing inward actuation (55-A) towards the opened position (62-B).

6 Claims, 6 Drawing Sheets

U.S. PATENT DOCUMENTS

| | | | | | |
|---|---|---|---|---|---|
| 5,048,150 | A | | 9/1991 | Guerin | |
| 5,075,923 | A | | 12/1991 | Taylor | |
| 5,083,342 | A | | 1/1992 | Klinefelter | |
| 5,293,666 | A | | 3/1994 | Armstrong | |
| D356,938 | S | | 4/1995 | Duffy | |
| 5,529,148 | A | | 6/1996 | O'Leary | |
| 5,592,780 | A | * | 1/1997 | Checkovich | 16/49 |
| 5,630,248 | A | | 5/1997 | Luca | |
| 5,649,339 | A | * | 7/1997 | Reed | 16/50 |
| 5,659,925 | A | | 8/1997 | Patterson | |
| 5,706,551 | A | | 1/1998 | Jeynes | |
| 5,829,098 | A | | 11/1998 | Alonso | |
| 5,832,562 | A | | 11/1998 | Luca | |
| 5,842,255 | A | | 12/1998 | Luca | |
| 5,855,039 | A | | 1/1999 | Crawford | |
| 5,953,789 | A | | 9/1999 | Alonso | |
| 6,032,331 | A | | 3/2000 | Alonso | |
| 6,138,412 | A | | 10/2000 | Reickmann | |
| 6,397,431 | B1 | * | 6/2002 | Alonso | 16/66 |

* cited by examiner

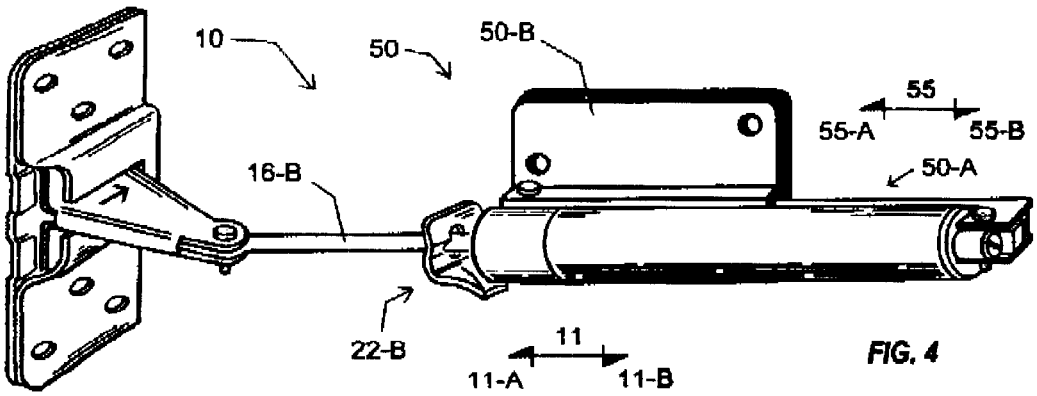
FIG. 4
FIG. 5
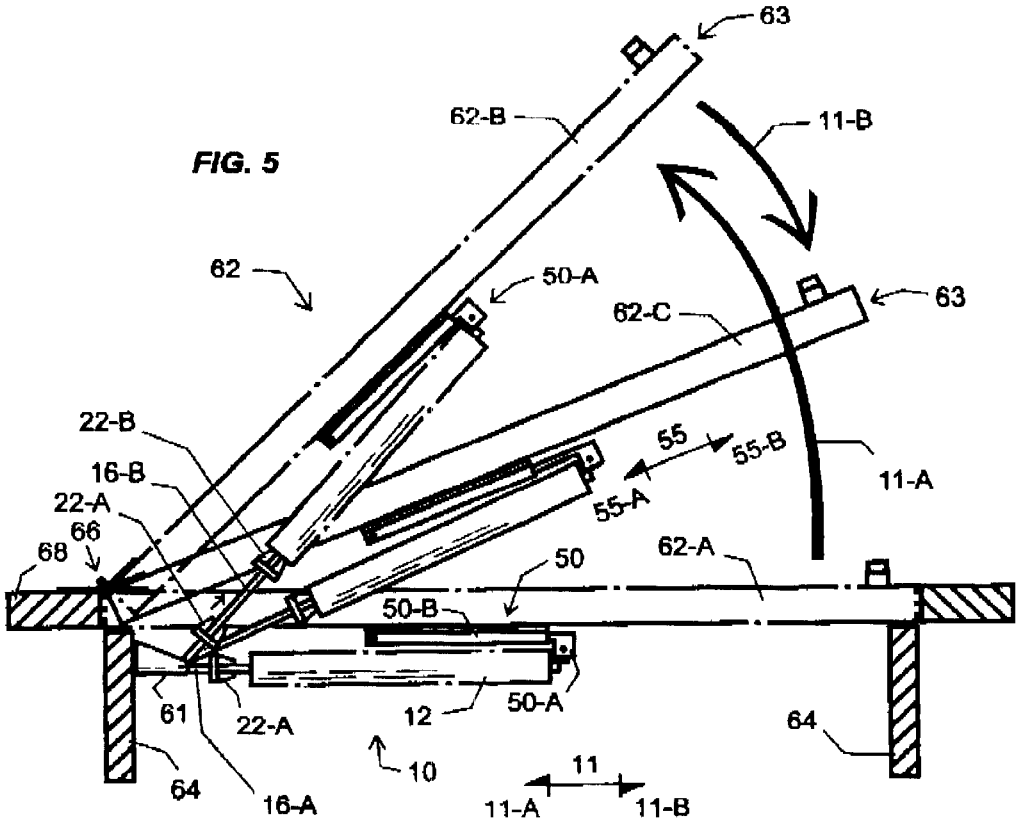

FIG. 7
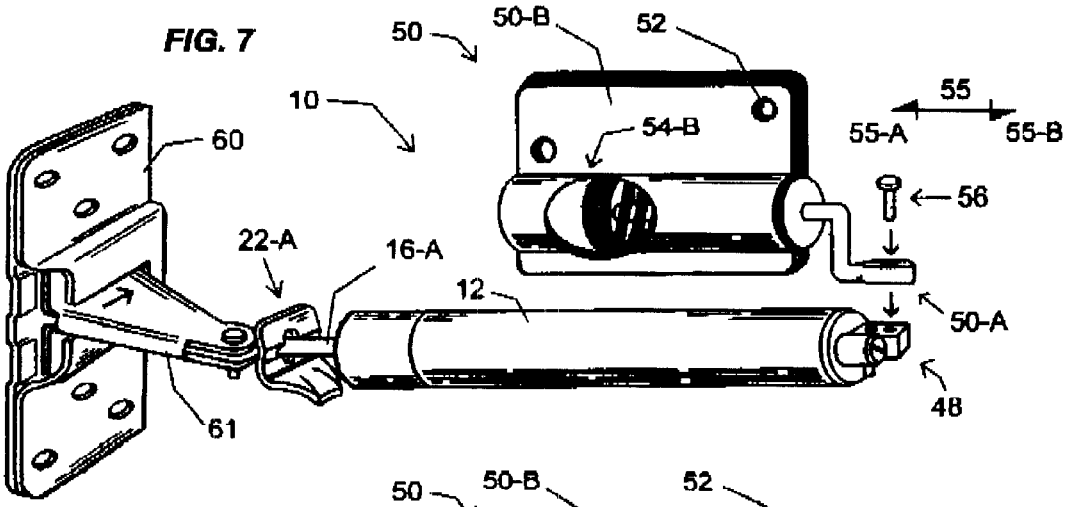
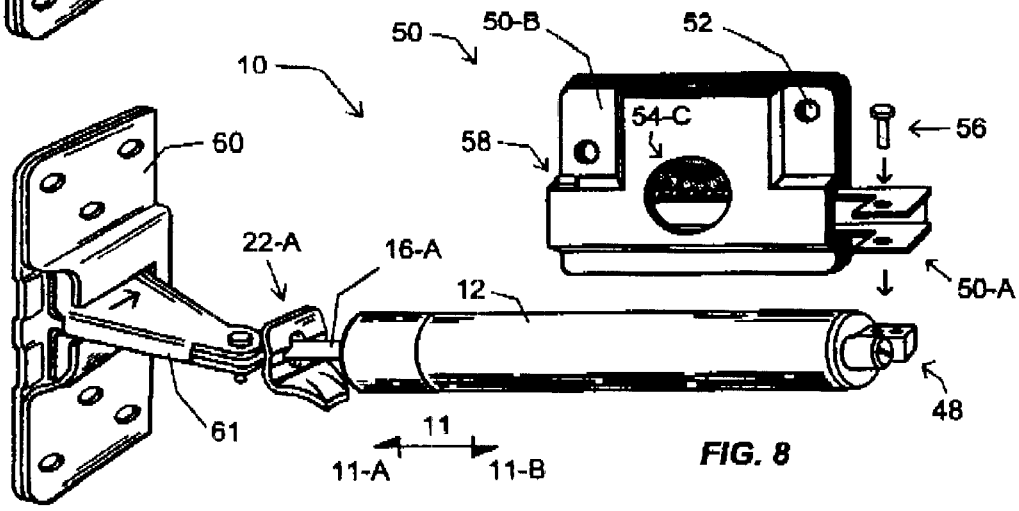
FIG. 8
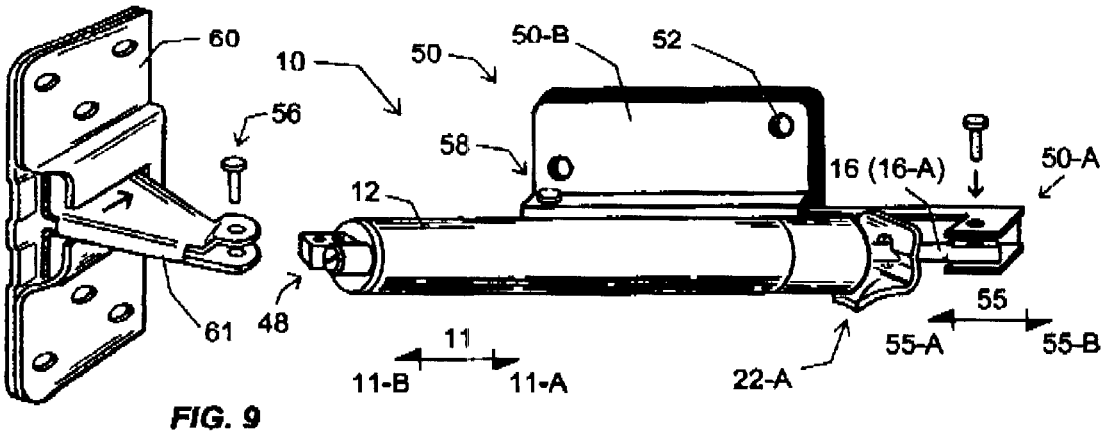
FIG. 9

*FIG. 10*

List of Reference Numeral

10 reciprocative device

11 biasing means of 10
- 11-A outward biasing force
- 11-B inward biasing force

12 piston body of 10

15 damper cover of 10

16 piston rod of 10
- 16-A retracted position
- 16-B extended position

22 checking mechanism of 10
- 22-A idle position
- 22-B engaged position

48 lug mount of 12

50 damper assembly of 10
- 50-A [hinge] extensible bracket
- 50-B fixated bracket

52 offsetting fastener means of 50-B

54 operator of 50
- 54-A spring operator
- 54-B fluid operator
- 54-C cog operator

55 counter biasing means of 50
- 55-A counter inward force
- 55-B counter outward force

56 lug pin of 48

58 lock means of 50-B

60 clip plate of 10

61 doorjamb bracket of 60

62 contingent door of 10
- 62-A closed position
- 62-B opened position
- 62-C dampened position

63 outermost edge of 62

64 doorjamb of 62

66 door hinge of 62

68 door frame of 62

DAMPER ASSEMBLY THAT OPTS TO OPEN DOORS FOR USAGE WITH RECIPROCATING DOOR CLOSER DEVICES

This is a continuation-in-part of U.S. Ser. No. 09/473,822 filed on Dec. 28, 2000. U.S. Pat. No. 6,397,431 issued on Jun. 4, 2002.

TECHNICAL FIELD

This invention relates to various reciprocative devices normally comprising a rod that functions from within a body controlling a biasing means operator. A reciprocating door closer installed on a contingent screen or storm door exemplifies such a device.

To close the door, the rod reciprocates responsive to the biasing means controlled by the device, comprising normal operation to substantially cause the door towards a closed door position. The rod can be loosely mounted with a checking mechanism for holding the door in an opened position. Utilizing the biasing means, the mechanism simultaneously engages the closer rod and the body to transpose the biasing means into friction pressure applied to the surface of the rod. Resultantly, the door is held to an opened position by the checking mechanism. More particularly, this invention relates to an improved apparatus and methodology to dampen, counter, and protect the device and the contingent door from damage due to excessive inward biasing forces, and to compensate for a superior checking mechanism which can now be commissioned to variably open the door. The invention may be incorporated with U.S. Pat. Nos. 5,829,093; 5,953,789, and 6,032,331 all to Alonso for creating a preferred door operator device.

BACKGROUND ART

A portion of the disclosure of this patent document contains material which is subject to copyright protection. The copyright owner has no obligation to the facsimile reproduction by anyone of the patent document or the patent disclosure, as it appears in the Patent And Trademark Office patent file or records, but otherwise reserves all copyright whatsoever.

A brief description of a reciprocative device includes a basic door closure device which is controlled in part with fluid, either hydraulic or pneumatic. The device may typically comprise a piston assembly including a piston and sailing o-ring; piston rod varieties which include curved and non-curved surfaces; internal compression spring operators and fluid biasing operators; cylindrical piston body; sealed and non-scaled end caps and grommet; fluid restriction valves; attachment members; and the checking mechanism which holds the door opened. Such door closer devices are described in U.S. Pat. Nos. 2,732,920; 2,920,338, 3,032,806; 3,162,699; 3,566,435; 3,665,549; 4,777,698; and Can. Pat. No. 623,038. A superior checking mechanism is extensively described in U.S. Pat. Nos. 3,953,789 and 6,032,331.

Most prior art reciprocative door closer device normally comprise at least one rod which reciprocatively functions from within a body having an internal biasing means operator. The operator normally actuates for controlling two distinctive forces common to the device and the position of the door: an outward biasing force which is increasingly actuated responsive to causing the door towards the opened position, and, as inward biasing force which is decreasingly actuated while causing the rod and door towards the closed position. Normally, upon applying an external outward force the biasing operator immediately acts to counter and control the inward force. The investor believes that despite origin of the biasing forces, if either caused externally as through human interference, or if caused internally as from the device, the two forces are clearly and distinctly taught as absolutely equating towards the door position relational to the force of the device.

The checking mechanism, also mown as a hold-open tab, is axially mounted onto the rod through an aperature. The bold-open feature is manually activated by first opening the door to a desired position, thus creating an outward biasing force that controls the extending piston rod from within the piston body. A biasing inward force is then reciprocatively created and controlled by the internal biasing operator. Releasing the door, the internal operator decreasingly actuates an inward biasing force to return the rod and close the door. Once the piston body contacts the mechanism, the biasing force causes the mechanism to lever. A direct frictional pressure is torsionally created by opposing points comprised within the aperture, applied onto surfaces of the piston rod whereby the mechanism frictionally checks the device to hold the door opened. More biasing force controlled by the internal operator results in more direct pressure causing the friction onto the surfaces of the rod. As with all prior art reciprocative devices utilizing checking mechanisms, before closing the door the mechanism must be disengaged in order to return the extended rod back into the closer body. Note that U.S. Pat. No. 2,732,920 describes a cog method of checking the rod however functions similar to other prior art devices.

The art has never before revealed any substantial reason to dampen the device to protect from damage due to excessive inward biasing forces, nor to compensate for a superior checking mechanism. Prior art checking mechanisms for reciprocating door closer devices are manufactured from common sheet steel which is relatively soft and will easily slip on the rod towards failure fail when placed under similar excessive inward forces. When a door is being held opened with any checking mechanism, excessive inward biasing forces can be caused by an unsuspecting person that ages to close the door without first disengaging the mechanism. Because the rod care not reciprocate back towards the body, the extended rod therefore becomes excessive and may subject the door and device to extensive damage. A superior mechanism that is substantially tempered and hardened may not reveal any give to compensate for the excessive inward force. Not knowing that the door is actually being held opened by the mechanism, tremendous leverage may be generated by pushing on the outermost edge of the door. The person's psychological then physical reaction may be to push harder in an effort to close the door. Most prior art mechanisms we manufactured from common sheet steel which is relatively soft and can fail when placed under similar excessive inward biasing forces.

However, a superior mechanism that is substantially tempered and hardened may increase the life of the door closer device, but unfortunately will not reveal any give to compensate for the excessive inward biasing force. Substantial damage to various components may include the contingent door and door frame, and the door closer device. If the device is not equipped with a clip plate to accommodate the doorjamb bracket, the bracket may be forcibly detached from atop the doorjamb. Because the device is typically fastened to the door with sheet metal screws that do not penetrate the entire substance of door, such as with a bolt and threaded fastener nut, the device may there be forcibly loaded from atop the door. These and other issues create a shortened life span for the device, which coincidentally offers the industry certain obsolescence resulting in frequent consumer purchases. The reader will also realize that the invention may be adapted onto any device including chose not equipped with a superior checking mechanism.

Another issue of concern defines the need for better convenience when utilizing the checking mechanism to hold the door opened for certain passage through the doorway. When people using mobility products such as wheelchairs and walkers encounter a door having a door closer device, often the device alone poses an extreme inconvenience. First, the user can not easily access the checking mechanism to hold the door opened especially if the device is located at the top of the door. Second, not only is it difficult to position the mobility product to engage the mechanism, it then becomes difficult or impossible to disengage it to close the door especially once the user is positioned on the door side opposite from the closer. Without the use of a hold-open tab to pass through the doorway, the user is not only burdened to fully open the door for accommodating the chair or walker, but must also try to push the door while negotiating through the doorway. Other door closer devices comprise checking mechanisms that are permanently attached to the closer body and require that the user push a button on the device to check the door. However, to close the door the user must cancel the checking mechanism by either again pushing the button on the device, or pushing the door further outward.

FIG. 10 illustrates a prior art door closer device (10) not to be confuse as anticipating the inventive concepts submitted herein. The coil spring assembly (50) is adapted to function with the rod (16) and the doorjamb bracket (61), for only protecting the device (10) and contingent door (not shown) from an excessive outward biasing forces (11-A) particularly from a sudden wind gust. As the rod (16) is maximally extended from the body (12), the coil spring assembly (50) dampens by providing a minimal reciprocative movement. Known with absolute certainty, this assembly does not dampen, counter, protect nor compensate the device and the contingent door from damage due to any excessive inward biasing forces. It is unclear as to why the art would offer such this assembly on the exterior piston rod of the devices as a similar assembly has long been implemented on the interior of the piston body. I believe that this exterior assembly merely complicates the device and does not offer any substantial benefit over the previous interior assembly. Replacement options for the checking mechanism are also substantially eliminated. Respectfully, none of the disclosure of this prior an assembly are anticipated, required, initiated, nor beneficial towards the superior inventions disclosed herein.

DISCLOSURE OF THE INVENTION

The present invention comprises a damper assembly adapted to a reciprocative door closer device and contingent door. Objects of these inventions are to dampen, counter, and protect the device and the contingent door from damage due to excessive inward biasing forces. Other objects of these inventions are to compensate the device for a superior checking mechanism. Other objects of these invention are to provide better convenience when utilizing a checking mechanism to hold the door opened for passage through the doorway, especially for people using mobility products such as wheelchair and walkers. Other objects of these invention are to optionally convert the door closer device into a door operator capable of opening a door to various positions determined by the location of the hold-open tab engaging the rod. Other objects of these invention are to create an inexpensive door operator device without substantially impeding the closing function of the door closer device. Other objects of these inventions are to permit the door to be closed when the rod is held in an extended position with a checking mechanism mounted onto the device. Other objects of these inventions are to activate an automatic door open feature by simply unlatching and pushing the door outward from a closed position. Other objects of these inventions are to variably regulate the distance that the door will automatically open determined and coinciding with the position of the checking mechanism engaged on the rod. Other objects of there inventions are to close the door with a gentle nudge. Other objects of these inventions are to permit the door to be closed smoothly without any bouncing.

The damper assembly may comprise a fixated bracket comprising an offsetting fastener meaner. Objects of there inventions are to permit universalness for a singular assembly that is adaptable to left and right hinging doors. Other objects of these inventions are to improve the fastener screws for the fixated bracket. The fixated bracket may house an extensible bracket also controlling a separate counter biasing means by usage of an operator, similar the reciprocative device adapted thereto. The extensible bracket may be further urged by the operator to control a counter outward biasing force acting to accommodate the extended rod of the device, and a counter inward biasing force acting to return the device to a normal position. Objects of these inventions are to return the device and contingent door to a normal position determined by the checking mechanism engaging the rod, thus causing the device to open and hold the door responsive to the position of the mechanism. Other objects of these inventions are to move the door to a fully closed position while the checking mechanism remains engaged on the extended rod of the device. Other objects of these inventions are to alleviate the need to return the checking mechanism to an idle position on the rod before returning the door to the closed position. Other objects of these inventions are to accommodate the length of extended rod by compensating the device. Other objects of these inventions are to create a door operator that offers a consistent and gentle operating pressure to move the door. Other object of these inventions are to create a no-pinching design which does not permit children to pinch fingers that are accidentally placed inside the assembly. Other objects of these inventions are to shorten the time required for the door to move to the closed position from any normally opened position. Other objects of these inventions are to close an unattended door being held opened by a checking mechanism during sudden wind gust conditions and if the wind is sufficient to create momentum for the door.

The counter biasing means may be controlled by various operators including the group of a spring operator means, a fluid operator means, and cog operator means. Objects of these inventions are to permit selection from various improved apparatus and methodologies without straying tram the inventive concepts disclosed herein.

The assembly can be bypassed and easily locked off try using a simple lock means to block the action of the extensible bracket. Other objects of these inventions are to allow the device to function similarly to a prior art device The members and other components may be substantially tempered and hardened. Objects of these inventions are to provide long life for the door closer device. Other objects of these inventions are to provide maximum strength for the device.

These and further objects and advantages of the invention will be apparent from the following description of the preferred embodiments thereof.

BRIEF DESCRIPTION OF THE DRAWINGS

FIG. 4 is a prospective view of the device of FIG. 3 as the damper assembly is urged into a dampened position without cause to the extended rod of the device.

FIG. 5 is a top view of a door mounted with a reciprocative door closet device and damper assembly shown in the three positions described above: a closed position; an opened position; and a dampened position.

FIG. 7 is a prospective view of a conceptual reciprocative door closer device and the invention, a damper assembly and biasing means operator comprising a fluid means.

FIG. 8 is a prospective view of a conceptual reciprocative door closer device and the invention, a damper assembly and biasing means operator comprising a cog means.

FIG. 9 is a prospective view of a conceptual reciprocative door closer device now mounted with a damper assembly adapted on the piston rod.

FIG. 10 is a reference list.

Prior Art

Figure 11:
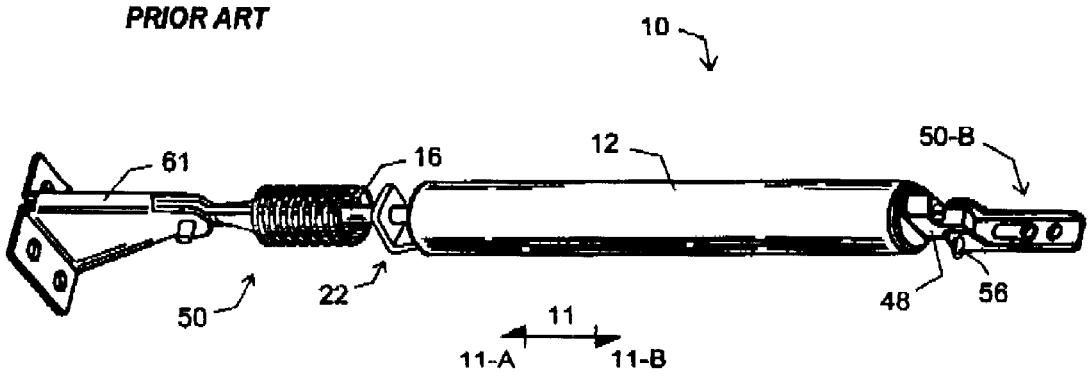

FIG. 11 is a prior art door closer device providing as assembly adapted on the exterior piston rod, limited to dampen and protect only from excessive outward biasing forces.

BEST MODES FOR CARRYING OUT THE INVENTION

Figure 1:
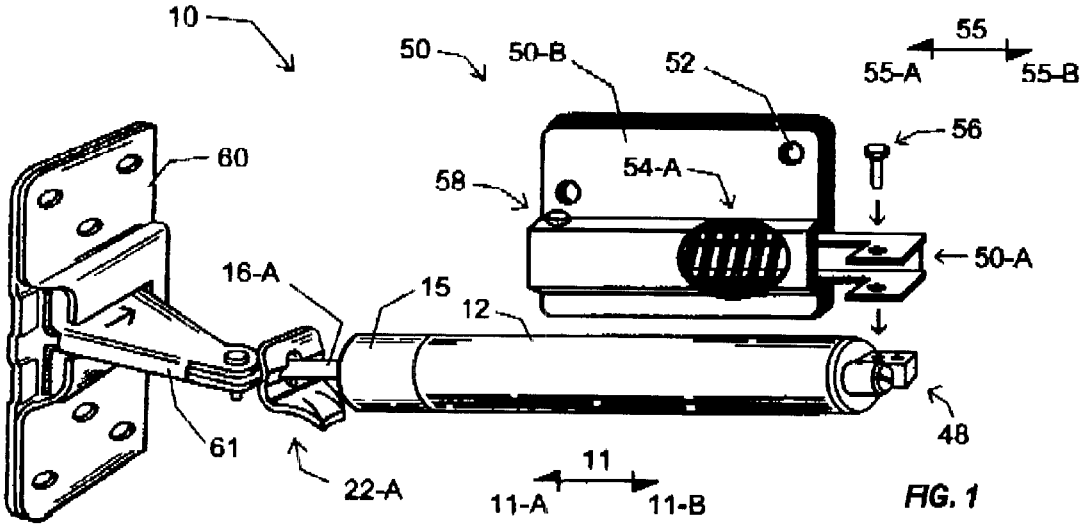
FIG. 1 is a prospective view of a superior reciprocative door closer device comprising a superior checking mechanism. The invention, a damper assembly is mount onto the device. A cutout on the assembly illustrates a spring operator means.

FIGS. 1–6 are taught conceptually together wherein FIG. 1 is a prospective view of a superior door closes device 10 comprising a piston rod 16 functions from within a piston body 12 controlling a biasing means 11. A superior, substantially tempered and hardened checking mechanism 22 is shown in an idle position 22-A, and is mounted onto the piston rod 16 shown in the retraced position 16-A. A clip plate 60 is accommodating the door jamb bracket 61 which normally mounts atop a doorjamb 64. The invention, a damper assembly 50 is positioned to mount onto the device 10 at the lug mount 48 using a lug pin 56 or similar fastener. The assembly 50 comprises a fixated bracket 50-B providing offsetting fasteners holes 52 for universal left and right attachment to a contingent door 62 and an extensible bracket 50-A which attaches to the mount 48 of the body 12. A cutout window illustrates that the extensible bracket 50-A is controlled by a spring operator 54-A capable of providing a counter biasing means 55.

Figure 2:
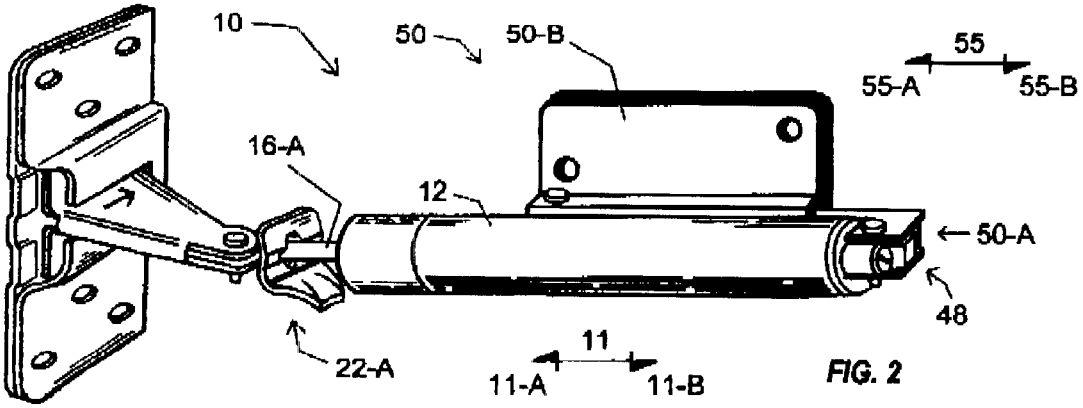
FIG. 2 is a prospective view of the device of FIG. 1 now mounted with the damper assembly shown in a normally retracted position.
Figure 3:
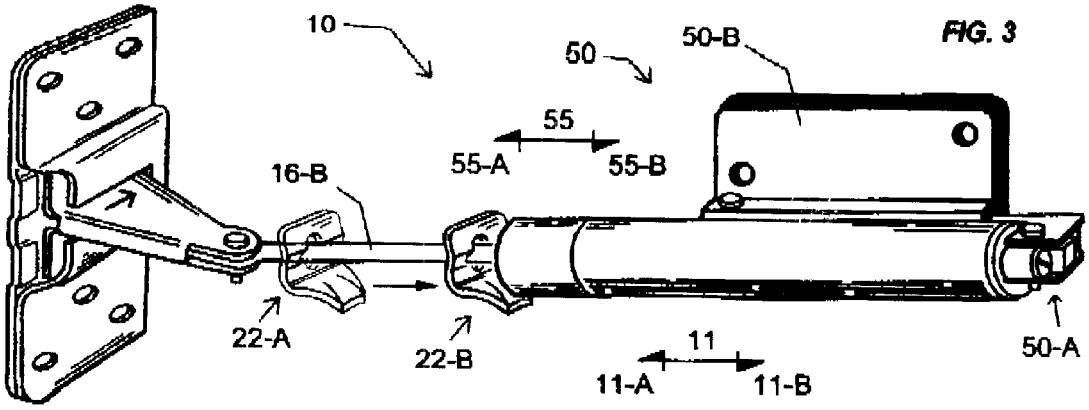
FIG. 3 is a prospective view of the device of FIG. 2 now engaged with the checking mechanism as to hold the extended rod for an opened door position.

FIG. 2 illustrates the damper assembly 50 now mounted onto the device 10, and shown to a normally retracted position comparable to FIG. 5 showing the normal door closed position 62-A. FIG. 3 illustrates that the rod 16 is in as extended position 16-B held with the engaged checking mechanism 22-B comparable to FIG. 5 showing the door in the opened position 62-B. FIG. 4 illustrates that the rod 16 is in an extended position 16-B and the assembly 50 is in a dampened position 62-C comparable to FIG. 5 showing the extensible bracket 50-A is responsively providing a coaster outward biasing force 55-B.

FIG. 5 is top view of the door closer device 10 end contingent door 62 shown is three positions: a closed position 62-A; an opened position 62B; and a dampened position 62-C. The device 10 functions as a biasing means 11 extends the rod 16 away from the body 12 with outward force 11-A, such as when a person moves the door 62 from the closed position 62-A towards the opened position 63-B. To hold the door, the idle checking mechanism 22-A is moved to engaged 22-B the rod 16 and check the inward force 11-B normally urging the rod 16 back into the body 12. As the door 62 is urged from the opened position 62-B towards the closed position 62-A such as when an unsuspecting person pushes on the door 62, the spring operator 54-A controlling the extensible bracket 50-A provides a counter outward force 55-B. Resultantly, the assembly 50 will dampen, counter, protect, and compensate the device 10 and contingent door 62 from damage due to the excessive inward biasing force 11-B that could normally result if the device 10 and door 62 were not mounted with the assembly 50. Note that assembly 50 is adapted to and mounted between the device 10 and contingent door 62 although it may be optionally mounted to either the closer body 12 or the piston rod 16.

Figure 6:
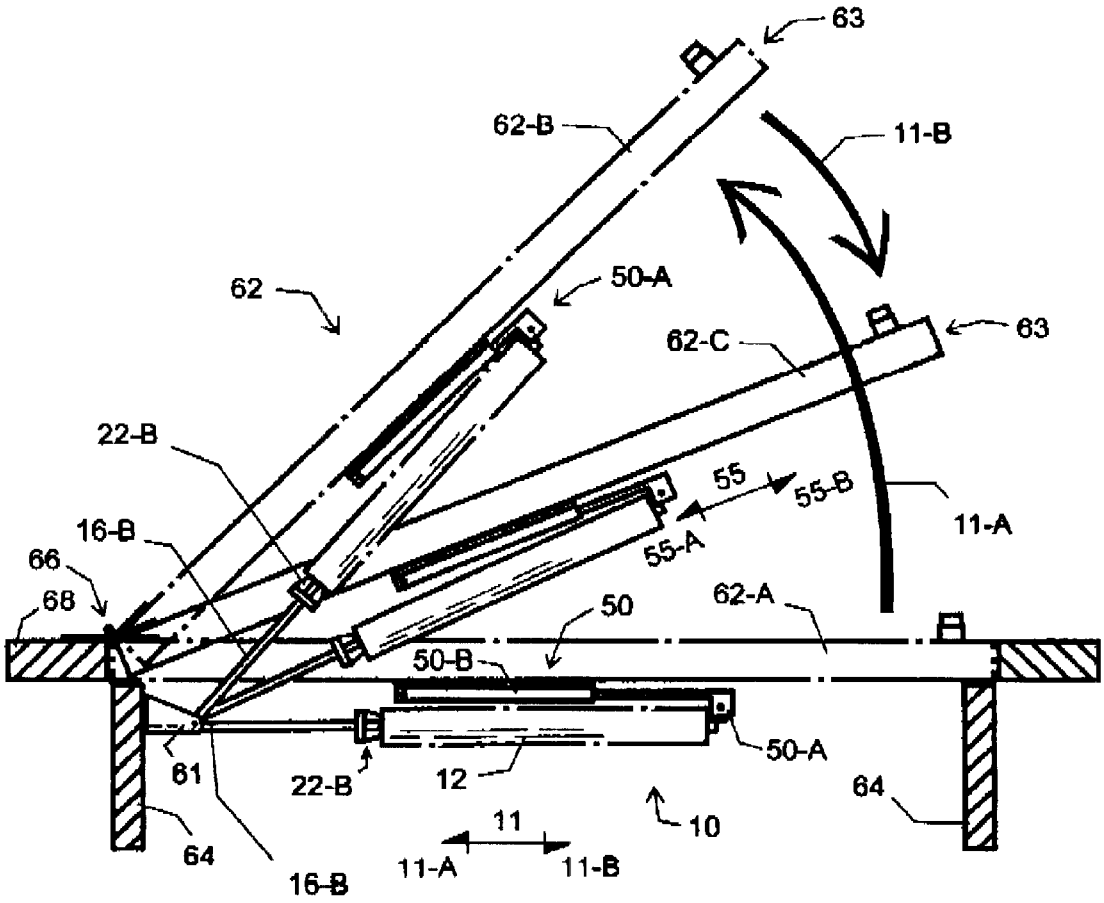
FIG. 6 is a top view of a reciprocative door closer device and damper assembly now set to optionally open the door from the closed position.

FIG. 6 is a top view of a door closer device 10 and contingent door 62 illustrating the inventive damper assembly 50 installed on a closed door 62-A now with the extensible bracket 50-A is compensating the extended rod 16-B which is being held by the engaged checking mechanism 22-B. The spring operator 54-A controls the counter inward biasing force 55-A and acts to return the door 62 to the normally opened position 62-B determined by the engaged checking mechanism 22-A holding the extended rod 16-B. To reactivate the door 62 to any opened position 62-B A once the checking mechanism (22) is engaged (22-B), the door 62 must simply be unlatch from the closed position 62. The distance that the door 62 can be opened is easily variable, coinciding with the position of the engaged mechanism 22-A on the extended rod 16-B, up to the point where the extensible bracket 50-A is maximally extended when the door 62 is in the closed position 62-A. Because of the reliability of the superior hold-open tab 22, which by natural gravity always remains poised for immediate engagement onto the extended rod 16-B, a unique memory is created to re-open the door 62 to the previous opened position 62-B determined by the engaged checking mechanism 22-A. Note that the damper assembly 50 may permit the checking mechanism 22 to engaged 22-A and disengaged 22-B without the need to move the door 62. By simply increasing the length of the extensible bracket 50-A, the assembly 50 can be designed to open and hold any door 62 to a fully opened position 62-B, a useful feature for people using mobility products such as wheelchair and walker users.

FIG. 7 is a prospective view of a superior reciprocators door closer device 10 equipped with a conceptual counter damper assembly 50 comprising a fluid operator means 54-B. FIG. 8 is a prospective view of a superior device 10 equipped with a conceptual damper assembly 50 comprising a cog operator means 54-C. These assemblies 50 comprise a fixated bracket 50-B housing an extensible bracket 50-A controlled by their respective operators 56-A,B,C, all capable of providing a counter biasing means 55. Perhaps these assemblies 50-B,C could also offer adjustability such as a valve for the fluid operator 54-B and a winding spring means for the cog operator 54-C. Note that any element of the assembly 50 comprising the spring operator 54-A may be used in conjunction with theses operators 56-A,B,C.

FIG. 9 is a prospective view of a superior reciprocative door close device 10 conceptually controlling a biasing means 11, now illustrated with the damper assembly 50 poised to be adapted the piston rod 16 and contingent door 62. Note that the biasing means 11 for the device 10 are referenced in reversal. As the inward biasing force 11-B may be checked with the mechanism 22, the extensible bracket 50-A may responsively provide a counter outward biasing force 55-B to dampen, counter, protect and compensate the device 10 and the contingent door 62 from any damage due to the excessive inward biasing forces 11-B.

Industrial Applicability

The present invention comprises a damper assembly adapted to and between a reciprocative door closer device and contingent door to dampen, counter, protect, and compensate the device and the door from damage due to excessive inward biasing forces, such as when the rod of the device is being held in an extended position with a superior checking mechanism and an unsuspecting person urges the door from an opened position towards the closed position. Resultantly, the assembly creates an inexpensive door operator device that comprises a unique door open and bold capability that is much needed for disabled and elderly people using mobility products such as wheelchairs and walkers. With certain devices, the assembly may be incorporated on the piston rod and/or the traditional method of mounting the door closer device may require that the rod mount onto the door. The invention may be installed onto various other reciprocative devices that do not comprise superior nor traditional checking mechanisms, as these devices may now comprise a limited life which could be extended by the invention. Other benefactor devices may include automotive lift supports, cabinetry and other similar door types. The invention may also be possibly incorporated on the exterior side of the door, possibly functioning with or without a traditional prior art door closer device. When combining these inventions with other related inventions, a superior reciprocative door operator device is created.

The particular embodiments of the present invention which have been illustrated and discussed herein are for illustrative purposes only and are not considered as a limitation upon the scope of the appended claims. In these claims set forth it is my intent to claim the entire invention disclosed herein, except as I am limited by the prior art.

Accordingly, the scope of the invention should not be determined only try the embodiments illustrated, true also by the appended claims and their legal equivalents. From the above description of the invention submitted, various changes and modifications and improvements may occur to the apparatus. All such claims are intended to be included therein.

I claim:

1. A method of causing a reciprocative door closer device (10) to move a contingent door (62) from a closed position (62-A) towards a normally opened position (62-B), said device (10) including a piston rod (16) comprising a checking mechanism (22) for variably holding said rod (16) in any extended position (16-B) and the door (62) in nay open position (62-B); said rod (16) functioning reciprocatively from within a piston body (12) controlling a biasing means (11) that upon an apply an outward biasing force (11-A) causing said rod (16) to move from a retracted position (16-A) towards the extended position (16-B), said device (16) normally acting to control a reciprocative inward biasing force (11-B) for again returning said door (62) towards the closed position (62-A) responsively, said method comprising the steps of engaging said checking mechanism (22-B) to hold said rod (16) in any extended position (16-B) while said door (62) remains in the said closed position (62-A);

preventing said rod (16) to move towards said retracted position (16-A) now creating excessive inward biasing forces (11-B) reactive to said mechanism (22-B) remaining engaged on said extended rod (16-B);

opposing said excessive inward biasing force (11-B) and compensating said extended rod (16-B) by use of a damper assembly (50) adaptable onto said device (10) and contingent door (62), comprising a fixated bracket (50-B) housing an extensible bracket (50-A) controlling a counter outward biasing means (55-B) by use of an operator (54);

urging said door (62) from said closed position (62-A) to return to said opened position (62-B) determined by said engaged checking mechanism (22-B) mounted on said extended rod (16-B);

wherein said assembly (50) responsively compensates said excessive inward force (11-B) by conversely providing an increasingly actuated biasing means (55-B) for causing said door (62) towards said closed position (62-A), and, a decreasingly actuated biasing means (55-A) for causing said door (62) again towards said opened position (62-B).

2. A damper assembly (50) adapted to a reciprocative door closer device (10) and contingent door (62); said device (10) comprising normal operation to substantially cause said door (62) towards a closed door position (62-A); said device (10) including a piston rod (16) which functions reciprocatively from within a piston body (12) having a biasing means (11), that, upon an applying an outward biasing force (11-A) comprising normally increasing actuation for causing said rod (16) and door (62) towards an opened position (62-B), said biasing means (11) acting to control an inward biasing force (11-B) comprising normally decreasing actuation for again causing said rod (16) and door (62) towards the closed position (62-A); said device (10) including a checking mechanism (22) for engaging and checking said inward force (11-B) and holding said rod (16) and door (62) towards any opened position (62-B); said assembly (50) comprising an extensible bracket (50-A) housing a fixated bracket (50-B) and operator (54) controlling a counter biasing means (55) comprising normal operation as substantially inactive unless, said assembly (50) detects that said inward force (11-B) has exceeded said device (10), including the excessive inward force (11-B) caused when the rod (16) held in an extended position (16-B) with an engaged checking mechanism (22) while the door (62) is forced towards the closed position (62-A) without first disengaging said mechanism (22);

wherein said assembly (50) responsively compensates said excessive inward force (11-B) by conversely providing an increasingly actuated biasing means (55-B) for causing said door (62) towards said closed portion (63-A), and, a decreasingly actuated biasing means (55-A) for causing said door (62) again towards said opened position (62-B).

3. The damper assembly (50) adapted to a reciprocative device (10) and contingent object (62) of claim 2, wherein said operator (54) is selected from the group of a spring operator means (54-A), a fluid operator means (54-B), and a cog operator means (54-C).

4. The damper assembly (50) adapted to a reciprocative device (10) and contingent object (62) of claim 2, wherein said fixated bracket (50-B) further provide a lock means (58) to cancel said counter biasing means (55) and permitting normal operation for said device (10) as though not equipped with said assembly (50).

5. The damper assembly (50) adapted to a reciprocative device (10) and contingent object (62) of claim 2, wherein said fixated bracket (54-B) comprising an offsetting fastener means (52) permitting universalness for a singular assembly (50) adaptable to left and right hinging doors (62).

6. An improved reciprocative door closer device (10) for controlling a contingent door (62); said device (10) normally operating to substantially cause said door (62) towards a closed door position (62-A) including a piston rod (16) which functions reciprocatively from within a piston body (12) having a biasing means (11), that, upon an applying an external outward biasing force (11-A) comprising normally increasing actuation for causing said rod (16) and door (62) towards an opened position (62-B), said biasing means (11) acting to counter and control an inward biasing force (11-B) comprising normally decreasing actuation for again causing said rod (16) and door (62) towards the closed position (62-A); said device (10) further including a checking mechanism (22) for engaging and checking said inward forces (11-B) and holding said rod (16) and door (62) towards arty opened position (62-B); said device (10) further including a spring assembly (30) comprising a hinge bracket (50-A) joined to a fixated bracket (50-B) and a spring means (54) opting a counter biasing means (55) to dampen, protect, and compensate said device from an excessive inward force (11-B) comprising said counter biasing means (55) providing normal operation to actuate substantial zero force as to not positively contribute affecting said biasing means (11) either for any increasingly outward force (11-A) towards the opened position (62-B), or, for any decreasingly inward force (11-B) towards the closed position (62-B), unless, said assembly (50) detects that said inward force (11-B) has exceeded said device (10), including the excessive inward force (11-B) caused when the rod (16) and door (62) are held in any opened position (62-B) with an engaged checking mechanism (22) and urged towards any closed position (62) without first disengaging said mechanism (22);

wherein said assembly (50) responsively compensates said excessive inward force (11-B) conversely without cause to said and (16), by then opting said ligamentous movement (55) to include as increasing actuation for causing said door (62) towards any closed position (62-A), and, a decreasing actuation for causing said door (62) again towards any opened position (62-B) to return said device (10) and door (62) towards any normal operation.

* * * * *